US009876287B1

(12) United States Patent
McRae

(10) Patent No.: US 9,876,287 B1
(45) Date of Patent: Jan. 23, 2018

(54) ELECTRICAL PLUG AND SOCKET ASSEMBLY FOR A SAFETY GROUNDED TREE

(71) Applicant: National Tree Company, Cranford, NJ (US)

(72) Inventor: Michael M. McRae, Ormond Beach, FL (US)

( * ) Notice: Subject to any disclaimer, the term of this patent is extended or adjusted under 35 U.S.C. 154(b) by 0 days.

(21) Appl. No.: 15/490,880

(22) Filed: Apr. 18, 2017

(51) Int. Cl.

| | |
|---|---|
| ***H01R 4/66*** | (2006.01) |
| ***H01R 24/22*** | (2011.01) |
| ***H01R 13/10*** | (2006.01) |
| ***H01R 13/02*** | (2006.01) |
| ***H01R 13/68*** | (2011.01) |
| ***H01R 13/631*** | (2006.01) |
| ***H01R 24/30*** | (2011.01) |
| ***H01R 13/645*** | (2006.01) |
| *H01R 103/00* | (2006.01) |

(52) U.S. Cl.
CPC ..... *H01R 4/66* (2013.01); *H01R 13/025* (2013.01); *H01R 13/10* (2013.01); *H01R 13/631* (2013.01); *H01R 13/6456* (2013.01); *H01R 13/68* (2013.01); *H01R 24/22* (2013.01); *H01R 24/30* (2013.01); *H01R 2103/00* (2013.01)

(58) Field of Classification Search
CPC ..... H01R 4/66; H01R 13/6456
See application file for complete search history.

(56) References Cited

U.S. PATENT DOCUMENTS

| | | | | |
|---|---|---|---|---|
| 4,403,824 | A * | 9/1983 | Scott | H01R 13/64 439/677 |
| 4,579,405 | A * | 4/1986 | Hirooka | H01R 9/2491 439/106 |
| 4,907,118 | A * | 3/1990 | Hames | H01R 13/6666 337/243 |
| 5,314,356 | A * | 5/1994 | Isohata | H01R 13/6456 439/680 |
| 6,402,547 | B1 * | 6/2002 | DeGutis | H01R 13/6392 439/501 |
| 2005/0151506 | A1 * | 7/2005 | Kennedy | H01R 27/00 320/111 |
| 2005/0236557 | A1 * | 10/2005 | Hurst | H01R 13/7038 250/214 R |

(Continued)

*Primary Examiner* — James Harvey
(74) *Attorney, Agent, or Firm* — James M. Smedley LLC; James Michael Smedley, Esq.

(57) ABSTRACT

An artificial lighted tree may have power routed through the tree trunk and three-wire safety grounding. A system and method are provided for preventing inadvertent electrical connection of a standard plug to a female socket of an electrical power cord to the artificial lighted tree. The apparatus and method comprise a non-standard female socket on a three-prong safety grounded electrical power cord. The non-standard female socket includes raised side socket walls with vertical half rounds in the sidewalls to mate with a non-standard two-prong non-polarized male electrical plug, customized to include mating grooves cut into top and bottom lips. Advantageously, use of a non-standard female socket paired with a non-standard two-prong non-polarized male electrical plug functions to prevent electrical connection by standard two-prong non-polarized male electrical plugs thereby permitting use of a three wire cord having lower amperage rating than standard UL approved three wire cord.

12 Claims, 5 Drawing Sheets

(56) References Cited

U.S. PATENT DOCUMENTS

| | | | | |
|---|---|---|---|---|
| 2015/0222057 | A1* | 8/2015 | Asper | A47G 33/12<br>439/108 |
| 2015/0380877 | A1* | 12/2015 | McRae | H01R 13/68<br>439/106 |
| 2017/0156535 | A1* | 6/2017 | Asper | A47G 33/12 |

* cited by examiner

ELECTRICAL PLUG AND SOCKET ASSEMBLY FOR A SAFETY GROUNDED TREE

FIELD OF THE INVENTION

The present invention generally relates to male electrical plugs and female socket electrical connections and, more particularly, is concerned with a non-standard female electrical socket, for instance, on the end of a power cord to exclusively mate with a non-standard two-prong non-polarized male electrical plug adapted for use with artificial lighted trees.

BACKGROUND OF THE INVENTION

Artificial pre-lighted Christmas trees, where the seasonal lights are incorporated on or with the tree, have become a popular alternative to both live trees and unlighted artificial trees. These trees are usually sectional for easy storage, with some lighted trees routing power for the lights up through the trunk of the tree with electrical connectors built into the ends of each tree section to distribute power to each section. A concern with such pre-lighted Christmas trees is the use of standard electrical receptacles for powering the lights up through the trunk of the tree. The vast majority of electrical receptacles are of the type that include one or more sets of fixed-position female electrical contacts that are configured to receive prongs (male electrical contracts) of appropriately oriented cord-connected plugs. Receptacles of this type are not part of a fused circuit and allow the cord to be of any gauge wire creating a further risk of undesirable electrical danger.

Therefore, there is a need in the art for a lighted artificial Christmas tree with a 3-wire safety ground connection and a non-standard female socket that overcomes the limitations of the prior art by allowing only non-standard fused plugs of a particular configuration and wire gauge to be used with the non-standard female socket. These and other features and advantages of the present invention will be explained and will become obvious to one skilled in the art through the summary of the invention that follows.

SUMMARY OF THE INVENTION

According to one embodiment of the present invention, an apparatus and method are provided for substantially preventing the inadvertent electrical connection of a standard plug to a female socket of an electrical power cord through which electrical power is supplied, for instance, to an artificial lighted tree. The apparatus and method comprise a non-standard female socket used in place of a standard female socket on a three-prong safety grounded electrical power cord that may, for instance, be used to power an artificial lighted tree. The non-standard female socket is configured to include raised side socket walls with vertical half rounds in the respective sidewalls to uniquely mate with a non-standard two-prong non-polarized male electrical plug, customized to include mating grooves cut into the top and bottom lips. Advantageously, use of a non-standard female socket paired with a non-standard two-prong non-polarized male electrical plug functions to prevent electrical connection by standard two-prong non-polarized male electrical plugs thereby permitting use of a three wire cord having a lower amperage rating than a standard UL approved three wire cord.

Another embodiment of the apparatus and method in accordance with the present invention provides a non-standard female socket used in place of a standard female socket on a three-prong safety grounded electrical power cord that may, for instance, be used with an artificial lighted tree. The non-standard female socket is configured to include a single raised side socket wall including a vertical half round in the single raised sidewall to uniquely mate with a non-standard two-prong non-polarized male electrical plug including mating grooves cut into the top and bottom lips. In a further embodiment, the apparatus utilizes a cover to prevent the inadvertent disconnection between the non-standard two-prong non-polarized male electrical plug and non-standard female socket.

According to one embodiment, a non-standard female socket used in place of a standard female socket on a three-prong safety grounded electrical power cord and comprises: (a) a socket body; (b) electrical contact means disposed on the inner socket body for receiving and engaging contact prongs of a non-standard two-prong non-polarized male electrical plug and for providing electrical connections with ends of the conductor wires of an electrical cord; (c) convex vertical half rounds formed in respective raised side walls of the non-standard female socket adapted to mate with a non-standard two-prong non-polarized male electrical plug including mating grooves cut into the top and bottom lips.

According to one embodiment, a non-standard female socket used in place of a standard female socket on a three-prong safety grounded electrical power cord and comprises: (a) a socket body; (b) electrical contact means disposed on the inner socket body for receiving and engaging contact prongs of a non-standard two-prong non-polarized male electrical plug and for providing electrical connections with ends of the conductor wires of an electrical cord; (c) a single convex vertical half round formed in a single raised side wall of the socket; (d) a cover for covering the engagement of the non-standard female socket with the non-standard two-prong non-polarized male electrical plug including mating grooves cut into the top and bottom lips.

According to embodiments of the present invention, a three-prong safety ground electrical power cord further comprises a foot switch configured to toggle on and off an electrical signal provided to the non-standard female end of the electrical power cord.

According to an embodiment of the present invention, the hot wires of the non-standard two-prong non-polarized male electrical plug enter the trunk of the decorative lighted hollow body Christmas tree through a securing grommet; wherein the ground conductor extends from the electrical power cord and terminates in a ground electrical connector configured to attach to the electrically conductive wall of the hollow body.

According to an embodiment of the present invention, the ground electrical connector is a ring terminal.

According to an embodiment of the present invention, the ground electrical connector is a conductive rigid tab.

The foregoing summary of the present invention with the preferred embodiments should not be construed to limit the scope of the invention. It should be understood and obvious to one skilled in the art that the embodiments of the invention thus described may be further non-standard without departing from the spirit and scope of the invention.

DETAILED SPECIFICATION

The present invention generally relates male electrical plugs and female socket electrical connections and more particularly to a non-standard female electrical socket, for instance, on the end of a power cord to exclusively mate with a non-standard two-prong non-polarized male electrical plug for use with artificial lighted trees. Specifically, embodiments of the present invention provide for a non-standard female socket and a non-standard two-prong non-polarized male electrical plug pair to be attached to and provide power and a safety ground connection for a powered decorative lighted Christmas tree. The decorative lighted Christmas tree includes power routed through the trunk of the tree and three-wire safety grounding. The system provides ways for mating the non-standard female socket as part of a power supply cord to the non-standard two-prong non-polarized male electrical plug to power the decorative lighted Christmas tree.

Figure 1:
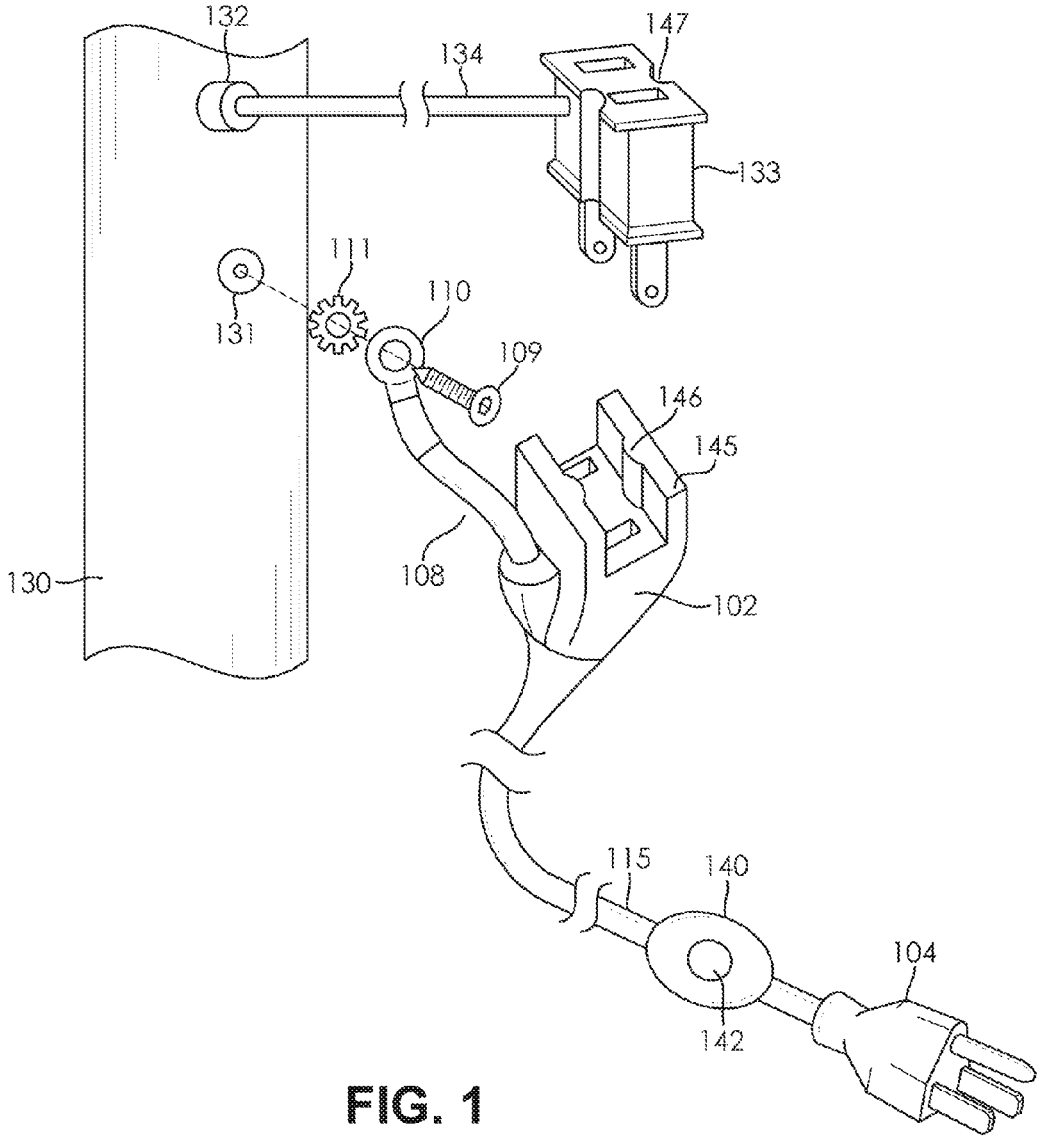
FIG. 1 shows a system for powering a decorative tree including a tree-mounted power cord with a non-standard female end which attaches to the powered decorative tree, according to an embodiment of the present invention.

According to an embodiment of the present invention, FIG. 1 shows a perspective view of a power cord 115 with a conventional 3-prong safety grounded plug 104 on the male end and a non-standard female socket 102 on the female end. The non-standard female socket 102 is shown to include convex vertical half rounds 146 formed in respective raised side walls 145 of the non-standard female socket 102 adapted to mate with a non-standard two-prong non-polarized electrical plug 133 including mating grooves 147 cut into the top and bottom lips. The non-standard female socket 102 of power cord 115 is positioned on a first surface of the female end and also positioned to a second surface of the female end that is non-coplanar to the first surface. The term non-coplanar here can refer to any portion of the female end which is not on the plane defined by the face of the female socket on the first surface. Instead of having a rounded socket to receive a ground prong on the first surface, a ground wire 108 extends out from the second surface of the non-standard female socket and is terminated with a ring terminal 110. This ring terminal 110 is attached to a bare metal ground point 131 on the decorative lighted Christmas tree trunk 130 with a tamper-proof screw 109 and a star washer 111. The power wires 134 of the non-standard two-prong non-polarized male electrical plug 133 enter the trunk of the decorative lighted Christmas tree trunk 130 through a securing grommet 132. Power is distributed within the Christmas tree to various sockets, connectors, and/or light strings on the decorative lighted Christmas tree. An important feature of the power cord 115 depicted in FIG. 1 is that the ground connection (e.g., ground wire 108) can be made independently of the hot and neutral connection of the non-standard two-prong non-polarized male electrical plug 133 without interfering with the ability of the non-standard two-prong non-polarized male electrical plug 133 to be plugged in and removed from the female end 120 of the power cord. One way of achieving this is by placing the ground connection 108 on a surface other than the first surface where the non-standard female socket 120 is placed.

Figure 2A:
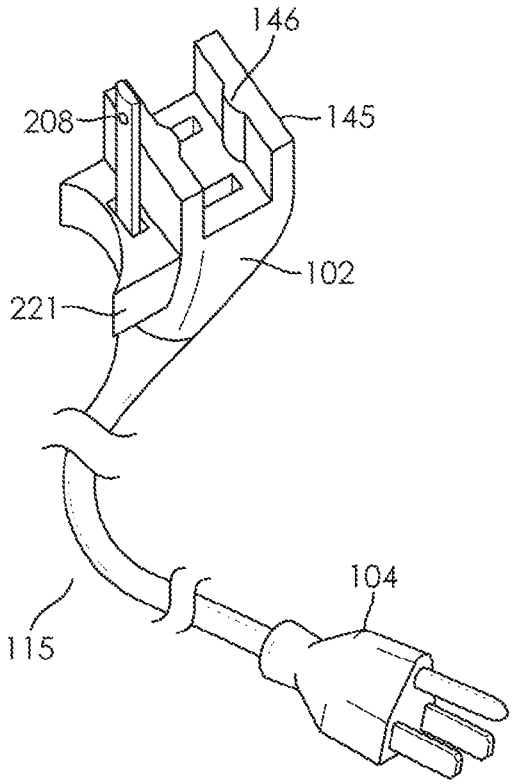
FIG. 2*a* shows a perspective view of a tree-mounted power cord of FIG. 1 with a non-conventional modified female end including half round verticals in raised sidewalls and a ground prong which attaches to a powered decorative tree through a grounding point, according to an embodiment of the present invention.

According to an alternate embodiment of the present invention, FIG. 2*a* shows a different version of the power cord 115 of FIG. 1. In accordance with the present embodiment, the ground wire 108 connection to the trunk 130 shown in the embodiment of FIG. 1 is replaced with a ground prong 208. The ground prong 208 is bent at two 90 degree angles so that it lines up flush with the Christmas tree trunk 130 and the molded base of the non-standard female socket 120. A curved portion 221 of the molded base of the non-standard female socket 102 of the female end is curved to fit the rounded trunk 130 of the decorative lighted Christmas tree.

Figure 2B:
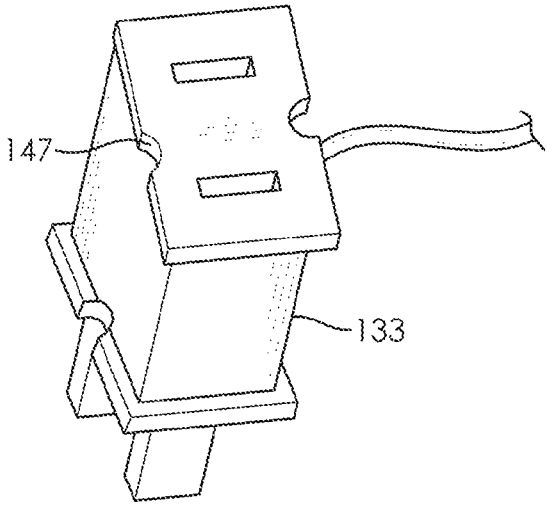
FIG. 2*b* shows a perspective view of a tree mounted non-standard two-prong non-polarized male electrical plug including grooves cut into the top and bottom lip portions of two faces of the plug which attaches to the powered decorative tree of FIG. 1, according to an embodiment of the present invention.

FIG. 2*b* shows a perspective view of the non-standard two-prong non-polarized male electrical plug 133 of FIG. 1. As shown, the non-polarized male electrical plug 133 includes mating grooves 147 cut into the respective top and bottom lips of the non-standard two-prong non-polarized male electrical plug 133 to mate with the non-standard female socket 102 of the power cord 115 as shown in FIGS. 1 and 2*a*.

In a preferred embodiment, in the non-standard two-prong non-polarized male electrical plug 133, both the hot and neutral wires pass through fuses (not shown) because there is no guarantee that the mating plug 133 will be connected in a particular orientation. Alternatively, a single fuse may be placed in the 3-prong safety grounded plug 104, as shown in FIGS. 1 and 2*a*, so that the single fuse is electrically connected in line with the hot wire. In this case, only a single fuse is needed in lieu of the doubly fused male mating plug 133. For safety, the 3-prong safety grounded plug 104 can be configured with a sliding door (not shown) providing access to the fuse. The sliding door only slides open when the grounded male mating plug 133 is not plugged into a female socket 102.

According to an alternate embodiment of the present invention, as illustrated in FIGS. 3-6, a different version of a tree-mounted power cord 115 includes a safety cover 344, shown in exploded view, and a conventional female socket 320 in lieu of the modified non-standard female socket 102 as shown in FIGS. 1 and 2*a*. In the present embodiment, the conventional female socket 320 attaches to both the trunk 130 of the powered decorative tree and to a non-standard two-prong fused non-polarized male electrical plug 333 which is of a different configuration than the one shown in FIGS. 1 and 2*b*.

Figure 4:
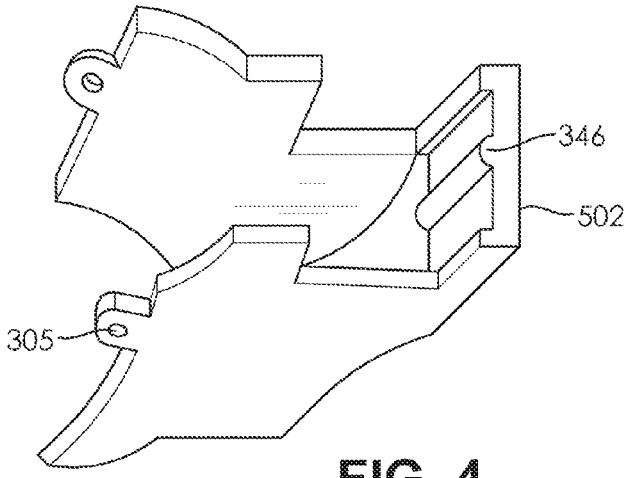
FIG. 4 shows a perspective view of the safety cover of FIG. 3, according to an embodiment of the present invention.

As best illustrated in FIG. 4, according to the presently described embodiment, the non-standard two-prong fused non-polarized male electrical plug 333 is shown to include a single mating groove 446 cut into the top and bottom lips. The power wires 534 of the non-standard two-prong fused non-polarized male electrical plug 533 separately attaches to the powered electrical tree 103 through a securing grommet 432, as shown in FIG. 5.

Figure 3:
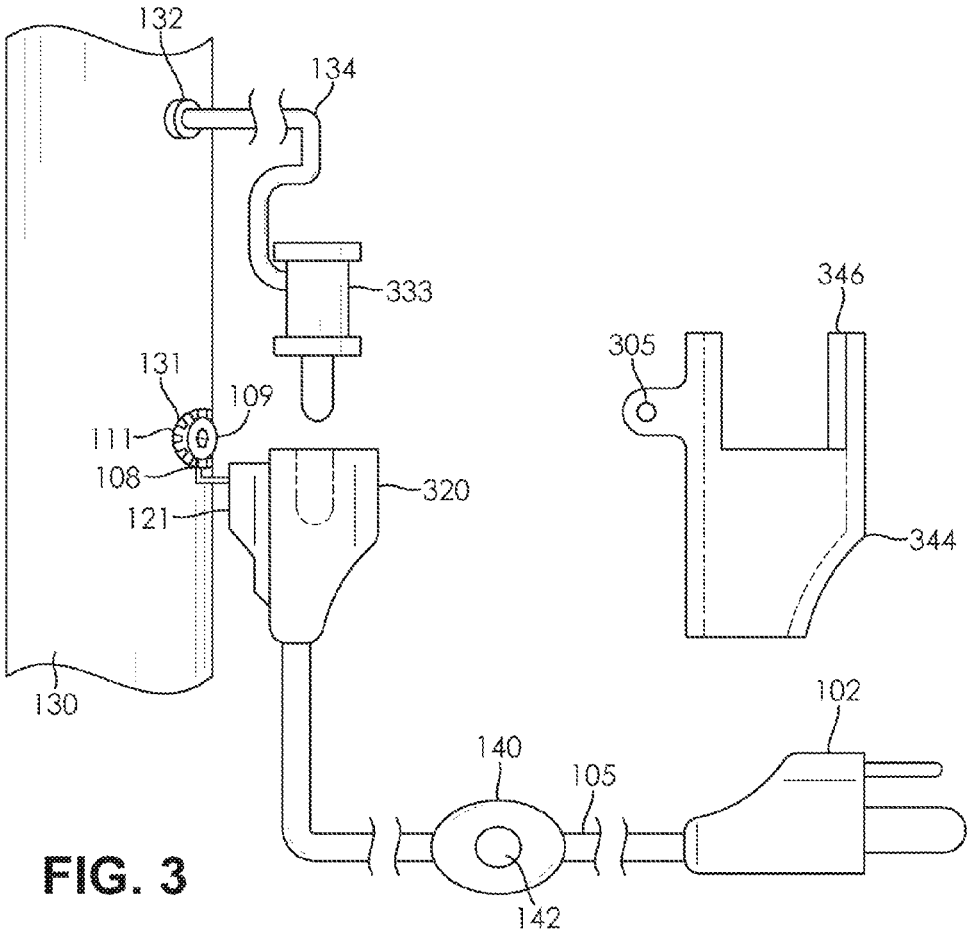
FIG. 3 shows a partially exploded view of a system for powering a decorative tree including a tree-mounted power cord with a non-standard female end which attaches to a powered decorative tree including a safety cover and an optional foot switch, according to an embodiment of the present invention.
Figure 6:
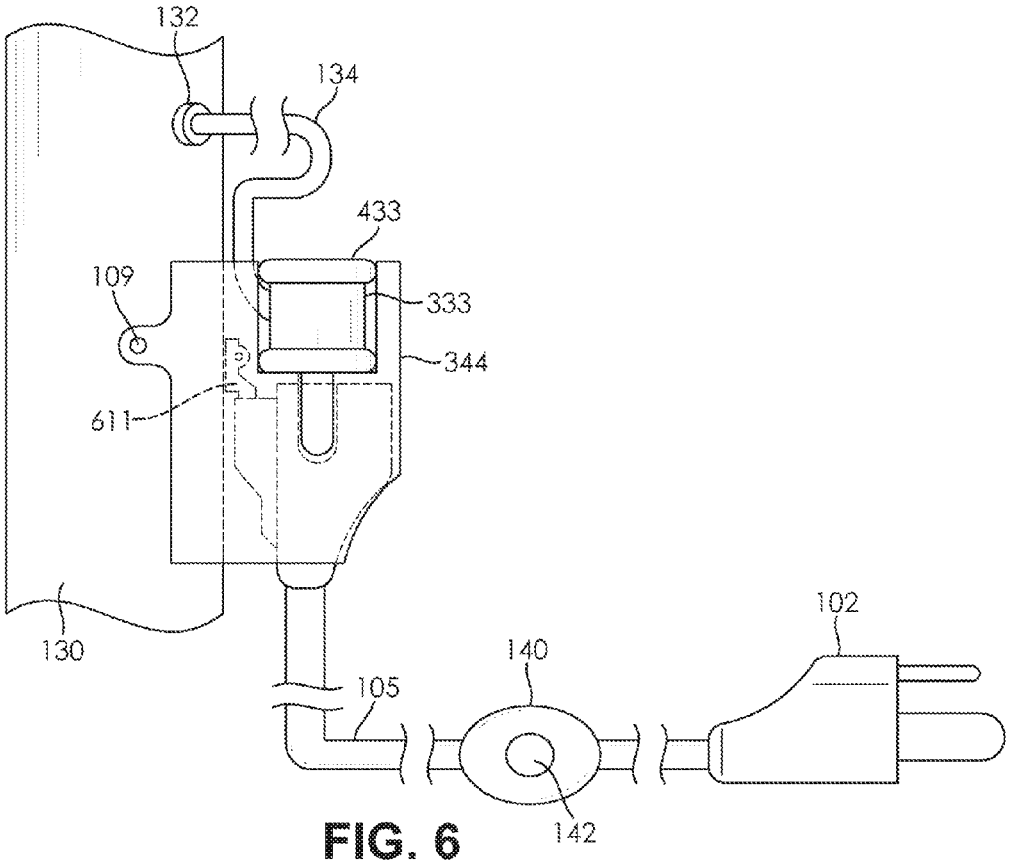
FIG. 6 shows a non-exploded view of the system of FIG. 3 for powering a decorative tree, according to an embodiment of the present invention.

As best shown in FIGS. 3 and 6, there is shown a safety cover 344 that attaches to the powered decorative tree via mounting holes 305 secured to attachment means, such as tamper proof screws 109. FIG. 6 shows the safety cover 344 fixedly attached to the trunk 130 of the powered electrical tree 103 via tamper proof screws 109. There is also shown grounding tab 611 secured to the tree trunk 130 via a tamper proof securing screw (not shown). The safety cover 344 is intended to cover both the non-standard two-prong fused non-polarized male electrical plug 533 and the standard conventional female socket 320 to prevent the inadvertent use of a standard conventional plug from being plugged into the power cord.

Figure 5:
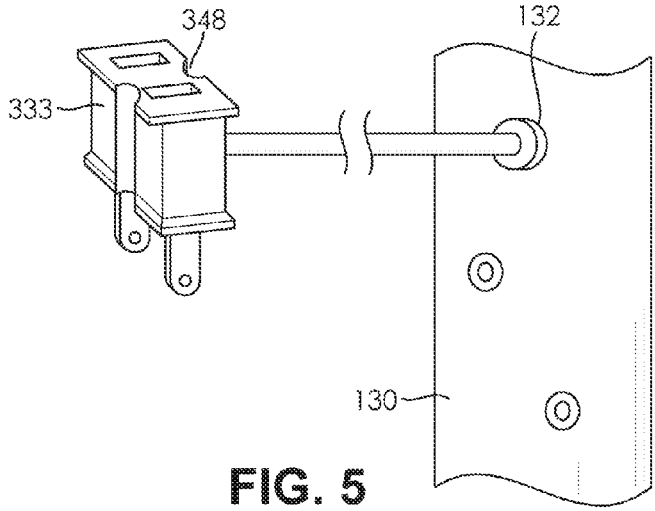
FIG. 5 shows a detailed view of the non-standard two-prong non-polarized male electrical plug of FIG. 3, according to an embodiment of the present invention.

As shown in FIG. 4, the safety cover 344 includes a single convex vertical half round 346 in an interior face of the safety cover 344 intended to mate with corresponding concave vertical half rounds 348 in the upper and lower lip of the non-polarized non-standard two-prong non-polarized male electrical plug 333, as shown in FIG. 5.

FIGS. 1, 3 and 6 show an optional foot switch 140 in line with the power cord 115. The optional foot switch 140 contains a push-button toggle switch 142 which controls power to the decorative lighted Christmas tree. The optional foot switch 140 allows for controlling the lighting of the tree. In other embodiments, the control of the lighting of the tree may be controlled by one or more control elements, such as a switch, a selector knob, an indicator panel, or any other human interface device (HID) or any combination thereof. One of ordinary skill in the art would appreciate that there are numerous types of control elements that could be utilized with embodiments of the present invention, and embodiments of the present invention are contemplated for use with any type of control element. According to another embodiment of the present invention, the foot switch may include electronics which convert the high voltage AC to low voltage DC and pass the ground connection through to the non-standard female socket 420 to allow for proper grounding even when high voltage AC is not used to run the lights on the decorative lighted Christmas tree.

Figure 7:
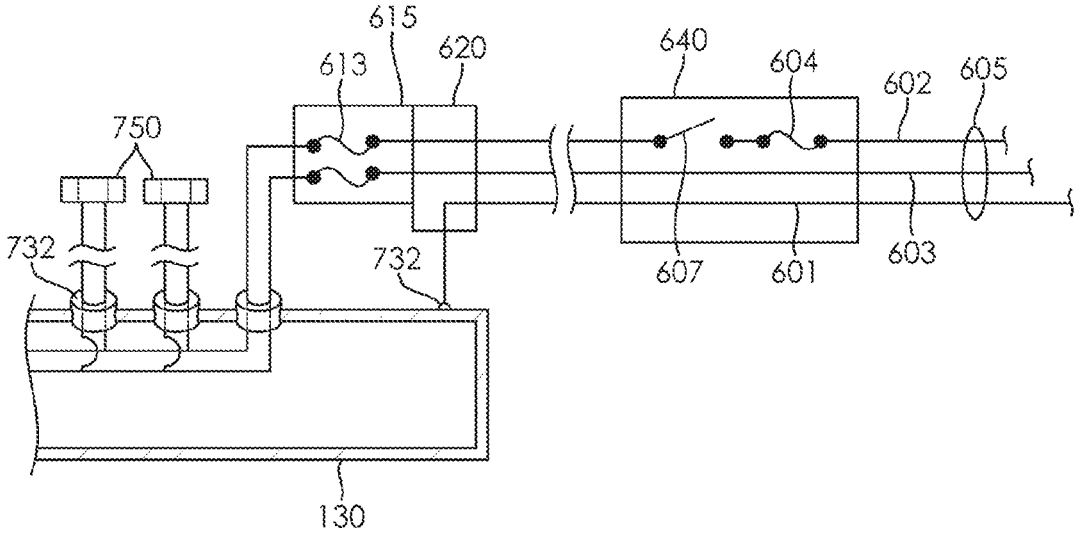
FIG. 7 shows a schematic diagram of a system for grounding a powered decorative tree according to an embodiment of the present invention.

According to another embodiment of the present invention, FIG. 7 shows a schematic diagram the safety grounded decorative lighted Christmas tree. The 3-prong safety grounded plug 115 sends electrical conductors through a single pole switch 607. In one embodiment this switch is the foot switch 120 shown in FIGS. 1, 3 and 6. An electrical connector 732 is then grounded to the conductive trunk 130, creating a ground connection from the conductive trunk 130 to the ground wire 601 through an attachment means, such as a screw. The hot wire 602, and neutral wire 603 pass through the electrical connector 420 to a corresponding connector 615 that houses two fuses 613. Alternatively the fuses 613 can be housed in the electrical connector 420, or elsewhere on the tree. The hot wire 602 and neutral wire 603 then pass into the trunk 430 through a securing grommet 732 to route power throughout the inside of the trunk. Side connectors 750 outside the trunk are connected to the hot 706 and neutral 707 wires that pass through securing grommets 732 from inside the tree trunk 130 to outside the tree trunk 130. The side electrical connectors 750 may be as simple as a wire, electrically connected to the wires inside the tree trunk 130, and merely passing through a hole (not shown) in the trunk 730 to the lights on the tree, or it may be a complex detachable multi-conductor connector as depicted in this application's parent application, U.S. patent application Ser. No. 14/317,291, entitled "Safety Grounded Tree" filed Jun. 27, 2014. One of ordinary skill in the art would appreciate that there are numerous types of side electrical connector that could be utilized with embodiments of the present invention, and embodiments of the present invention are contemplated for use with any appropriate type of side electrical connector.

One or ordinary skill in the art would recognize that wires are not necessary, and any conductor can be used, including, but not limited to, printed circuits, conductive paints, conductive liquids, or ionized gases. Embodiments of the present invention may incorporate one or more of these conductors in lieu of or in conjunction with the wires.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A system comprising:

(i) a non-standard power cord comprising:

a. at a first distal end:

(a) a non-standard socket body having a first surface and a second surface that is non-coplanar to the first surface;

(b) electrical contact means disposed on the inner socket body for receiving and engaging contact prongs of a non-standard two-prong non-polarized male electrical plug and for providing electrical connections with ends of the conductor wires of an electrical cord;

(c) a ground wire, electrically connected to a ground prong of a 3-prong safety grounded plug at a second distal end, the ground wire electrically connected to a conductive hollow trunk of a lighted artificial tree via a first attachment means;

(a) convex vertical half rounds formed in respective raised side walls of the first surface of the female socket;

b. at a second distal end:

(a) a 3-prong safety grounded plug;

(ii) a non-standard two-prong non-polarized male electrical plug including mating grooves cut into the respective top and bottom lips of the plug on a first and second surface of the plug.

2. The system according to claim 1, wherein the two-prong non-polarized male electrical plug is double fused.

3. The system according to claim 1, wherein the 3-prong safety grounded plug is singly fused.

4. The system according to claim 1, wherein the safety cover comprises a single convex vertical half round centrally located in a single sidewall configured to mate with the single mating groove cut into the respective top and bottom lips of the two-prong non-polarized male electrical plug.

5. The system according to claim 1, wherein the three-prong safety ground electrical power cord further comprises a foot switch configured to toggle on and off an electrical signal provided to the non-standard female end of the electrical power cord.

6. A system comprising:

(i) a non-standard power cord comprising:

a. at a first distal end:

(c) a non-standard socket body having a first surface and a second surface that is non-coplanar to the first surface;

(b) electrical contact means disposed on the inner socket body for receiving and engaging contact prongs of a non-standard two-prong non-polarized male electrical plug and for providing electrical connections with ends of the conductor wires of an electrical cord;

(c) a ground wire, electrically connected to a ground prong of a 3-prong safety grounded plug at a second distal end, the ground wire electrically connected to a conductive hollow trunk of a lighted artificial tree via a first attachment means;

b. at a second distal end:

(b) a 3-prong safety grounded plug;

(ii) a non-standard two-prong non-polarized male electrical plug including a single mating groove cut into the respective top and bottom lips of the plug; and (iii) a safety cover attached to the lighted artificial tree and arranged to cover the two-prong non-polarized male electrical plug, and the female socket and restrict access thereto.

7. The system according to claim 6, wherein the two-prong non-polarized male electrical plug is double fused.

8. The system according to claim 6, wherein the 3-prong safety grounded plug is singly fused.

9. The system according to claim 6, wherein the safety cover comprises a single convex vertical half round centrally located in a single sidewall configured to mate with the single mating groove cut into the respective top and bottom lips of the two-prong non-polarized male electrical plug.

10. The system according to claim 6, wherein the three-prong safety ground electrical power cord further comprises a foot switch configured to toggle on and off an electrical signal provided to the non-standard female end of the electrical power cord.

11. A power cord comprising:

c. at a first distal end:

(i) a non-standard socket body having a first surface and a second surface that is non-coplanar to the first surface;

(ii) electrical contact means disposed on the inner socket body for receiving and engaging contact prongs of a non-standard two-prong non-polarized male electrical plug and for providing electrical connections with ends of the conductor wires of an electrical cord;

(iii) a ground wire, electrically connected to a ground prong of a 3-prong safety grounded plug at a second distal end, the ground wire electrically connected to a conductive hollow trunk of a lighted artificial tree via a first attachment means;

(iv) convex vertical half rounds formed in respective raised side walls of the first surface of the female socket;

d. at a second distal end:

a 3-prong safety grounded plug.

12. The power cord according to claim 11, wherein the 3-prong safety grounded plug is singly fused.

* * * * *